United States Patent [19]

Kuchenbecker

[11] Patent Number: 4,471,884

[45] Date of Patent: Sep. 18, 1984

[54] GLUE FLAP CONSTRUCTION FOR A LINED CARTON

[75] Inventor: Morris W. Kuchenbecker, Neenah, Wis.

[73] Assignee: The James River Corporation, Norwalk, Conn.

[21] Appl. No.: 377,158

[22] Filed: May 11, 1982

[51] Int. Cl.[3] ..... B65D 9/08

[52] U.S. Cl. ..... 220/462; 229/3.1; 229/48 T

[58] Field of Search ..... 229/80, 48 T, 3.1, 44 R; 206/624; 220/453, 418, 462, 463

[56] References Cited

U.S. PATENT DOCUMENTS

| | | | |
|---|---|---|---|
| 968,738 | 8/1910 | Cagnoli | 229/80 |
| 2,387,272 | 10/1945 | Klein et al. . | |
| 2,463,313 | 3/1949 | Ringler | 220/418 X |
| 2,516,085 | 7/1950 | Williamson . | |
| 2,523,488 | 9/1950 | Williamson . | |
| 2,553,803 | 5/1951 | Zinn, Jr. . | |
| 3,580,483 | 5/1971 | Young . | |
| 4,239,150 | 12/1980 | Schadowski et al. | 229/48 T X |
| 4,250,994 | 2/1981 | Focke | 229/48 T X |

FOREIGN PATENT DOCUMENTS

| | | | |
|---|---|---|---|
| 1143385 | 2/1963 | Fed. Rep. of Germany | 229/36 |

*Primary Examiner*—Allan N. Shoap
*Assistant Examiner*—Robert Petrik
*Attorney, Agent, or Firm*—Finnegan Henderson Farabow Garrett & Dunner

[57] ABSTRACT

A construction for a lined carton, made of carton stock and a liner, the carton comprising a plurality of sidewall panel members and a glue flap. A liner substantially covers the carton stock. The glue flap has a projection on each of its ends, the thickness of a portion of carton stock comprising the projection being thinner than the thickness of the main portion of the carton. The invention includes a blank for forming a lined carton comprising a glue flap which has projections susceptible to being made thinner than the thickness of the main portion of the carton stock upon application of pressure to the projection.

11 Claims, 8 Drawing Figures

GLUE FLAP CONSTRUCTION FOR A LINED CARTON

BACKGROUND OF THE INVENTION

This invention relates to an improved glue flap construction for a lined carton, and more particularly to a glue flap construction which does not leave any ingress or egress channels, thus, rendering the carton more completely sealed.

There exists a variety of container structures designed to store various perishables and air and water sensitive contents. These containers provide some degree of protection against the infiltration of moisture and vapor to the carton's contents. These containers may be of a type known in the art as a "pouch". The pouch is composed of material of uniform thickness. The pouch material may be sealed according to a method known in the art as "fin sealing". The fin sealed pouch is generally moisture and vapor proof because the face to face "fin" seal is of uniform thickness and is generally accomplished without leaving air channels.

Pouch containers as described above have the advantage of being moisture and vapor proof but have certain disadvantages. Pouches are generally made of materials that are soft and pliable and are therefore not self-supporting or crush-proof. Pouches are also more difficult to fill than stiff cartons in certain applications. In an attempt to overcome these problems and still maintain a moisture and vapor resistant container, containers have been developed in which a pouch is incorporated into a carton. These cartons are known in the art as "bag in a box".

In a modification of the "bag in a box" type container a lined carton may be made from a lined carton blank that is folded and sealed. Such lined cartons when made from a blank which includes a moisture and vapor resistant lining attached to carton stock have many advantages. These advantages include ease of storing, since the blanks may be stored flat until needed; ease of filling for certain applications; resistance to crushing, etc.

Such cartons may be formed from a lined carton blank which is scored to define panels and flaps and tabs. The panels and flaps and tabs are folded to form the sides and ends of the carton, respectively. The blank includes a glue flap on one side for folding under the inner surface of a panel on the opposite side of the blank. A rectangular heat sealable liner is adhered to the inner surface of the carton blank. The glue flap is attached to a rectangular side panel.

In such cartons, the glue flap has glue applied to its outside surface. A portion of the liner material is then folded over the glue flap. The glue flap and adhered liner are then adhered to the under surface of a side panel on the opposite side of the blank when the blank is folded into a carton. Such a partially constructed prior art carton with the carton lying flat is illustrated in a top view in FIG. 1.

The folded carton blank is noted generally as 10. The glue flap 12 has been folded under an opposite side panel 16 of the carton. A liner 17 is attached to the entire inside surface of the blank 10. The end panels of the carton are designated as 11 and 13 and the dust flaps as 15 and 19. The end edges of the glue flap are designated 14 and the side panel to which the glue flap is attached is designated as 21. The glue flap, the main body and the liner are normally caused to adhere to each other by application of heat and pressure.

A problem arises in the above described standard construction carton. Referring to FIG. 2, which is a cross-section of the glue flap and adjacent area taken along line 2—2, it has been found, that upon folding of the glue flap and adhesion of the glue flap to panel 16 an air channel 22 is left between the folded layers of liner 17. It is hypothesized that air channel 22 is left because of the abrupt thickness differential that exists between the components that are adhered together to the right and left of glue flap edge 14 as viewed in FIG. 2. The presence of this sharp thickness differential along edge 14 causes channel 22 to be left between the liner material partially covering the glue flap and the liner material covering that section of the opposite side panel which is adhered to the glue flap section. A second channel 24 is also left but it is of no consequence since it is a "dead end" channel that does not have access to the inside of the carton. The creation of air channel 22 provides a means for outside air or water vapor to infiltrate the container or means for the contents of the container to escape.

Infiltration of moisture vapor into a container may damage perishable, or vapor sensitive contents of the container. Air channels may also permit escape of fine materials stored in the container. A problem, therefore, exists in the construction of lined cartons according to the described prior art technique, because of the leaving of air channels in the carton resulting from the abrupt thickness differential between the liner-covered glue flap area and the thinner adjacent area.

SUMMARY OF THE INVENTION

It is, therefore, the principal object of the present invention to improve the construction of a lined carton in order to prevent the leaving of air channels in a constructed carton. Elimination of such air channels results in a carton that is more completely sealed and impermeable to air or moisture vapor.

Other objects of the invention will be set forth in part in the description which follows and in part will be obvious from the description, or may be learned by practice of the invention. The objects and advantages of the invention are realized and obtained by means of the materials, methods and combinations, particularly pointed out in the appended claims.

The lined carton of the invention comprises a plurality of side wall panel members, end wall panel members, a glue flap, and a liner which substantially covers the carton stock and the glue flap. The liner extends beyond and folds back around the glue flap. The glue flap has a projection on each of its ends. The thickness of the portion of the carton stock which comprises the projections on the glue flap is thinner than the thickness of the main portion of the carton stock. In a preferred embodiment, the width of the projection from the glue flap becomes narrower as the projection extends outward of the glue flap to the tip of the projection.

The invention also relates to a blank for forming a lined carton made of carton stock having a generally uniform thickness, and a liner. The carton blank comprises a plurality of side wall panel members, end wall panel members, a glue flap, and a liner which substantially covers the carton stock and the glue flap. The liner extends beyond the glue flap. The glue flap has a projection on each of its ends. The thickness of the projection of the glue flap is susceptible to being made thinner than the thickness of the main portion of the carton stock upon application of pressure on the projecting portion. In preferred embodiments the width of a projection becomes narrower as the projection extends outward of the glue flap to the tip of the projection. In other preferred embodiments of the invention the width of a portion of the projection positioned outwardly of the glue flap is defined by a pair of planes that converge at the end of the projection. In another preferred embodiment, the tip of the projection forms a rounded peak. In another preferred embodiment, the tip of the projection is fiber frayed. In another preferred embodiment the projection has a triangular shape.

The tip of the projection of the glue flap is desirably positioned outwardly of the longitudinal center line of the glue flap.

The accompanying drawings which are incorporated in and constitute a part of the specification, illustrate the invention, and together with the description, serve to explain its principles.

BRIEF DESCRIPTION OF THE DRAWINGS

Prior Art

Prior Art

DETAILED DESCRIPTION OF THE INVENTION

Reference will now be made in detail to the present preferred embodiment of the invention, an example of which is illustrated in the accompanying drawings.

Figure 3:
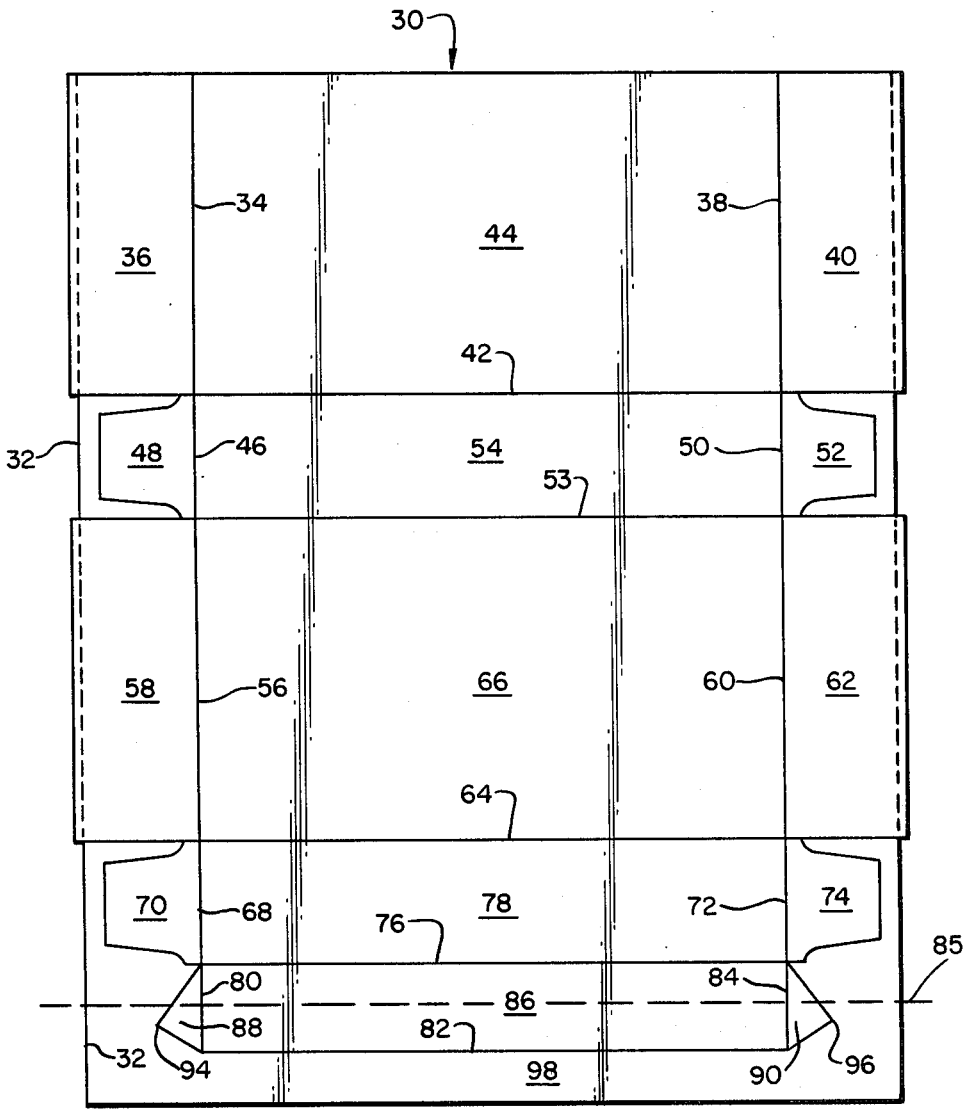
FIG. 3 is a top view of an unfolded carton blank according to the present invention.
Figure 3A:
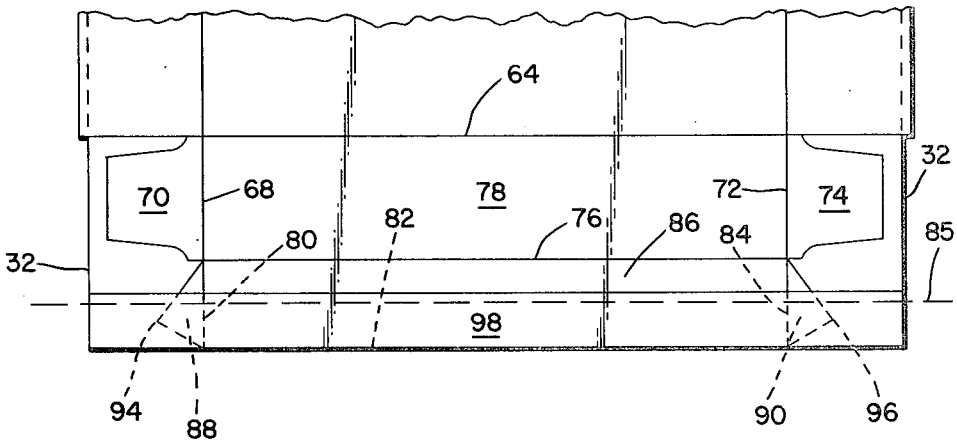
FIG. 3*a* is a partial view of the embodiment of FIG. 3 with the liner folded back around and over the glue flap of the present invention.
Figure 4:
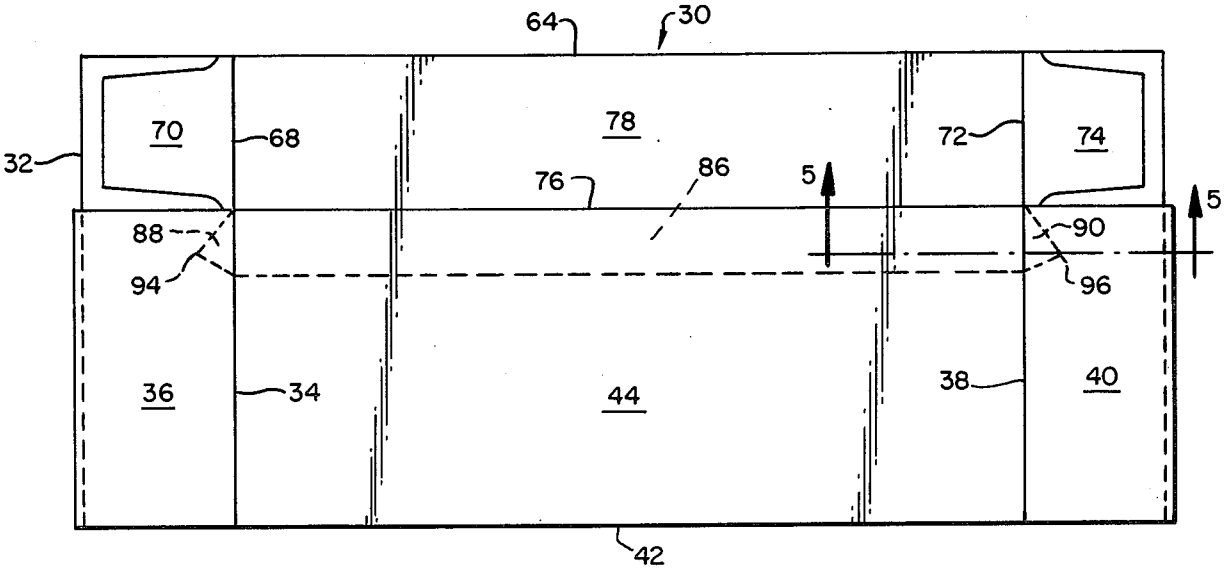
FIG. 4 is the top of a folded carton with improved glue flap construction according to the invention.
Figure 5:
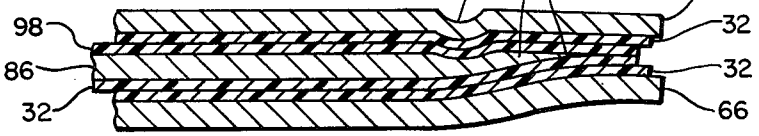
FIG. 5 is a cross-sectional view taken along lines 5—5 of FIG. 4 illustrating the area around the edge of the improved glue flap according to the invention.

The preferred embodiment of the lined carton of the present invention is shown in FIGS. 3, 4 and 5. FIG. 3 is a top view of a carton stock blank and attached liner for forming the lined carton according to the invention. The blank is noted generally by the numeral 30. The blank is made from paperboard carton stock that is cut into shape. A heat sealable liner 32 is bonded on the underside of the carton blank with adhesive at suitable areas.

The blank is scored to define a plurality of side wall panel members, end wall panel members and a glue flap. Scoring line 34 defines an end wall panel member 36, and scoring line 38 defines end wall panel member 40. Scoring line 42 along with scoring lines 34 and 38 border a side wall panel member 44. Scoring line 46 borders a dust flap end wall panel member 48. Scoring line 50 borders a dust flap end wall panel member 52. Scoring lines 53, 42, 46, and 50 define a side wall panel member 54. Scoring line 56 borders an end wall panel member 58. Scoring line 60 borders an end wall panel member 62. Scoring lines 64, 53, 56, and 60 define a sidewall panel member 66. Scoring lines 68 and 72 border a pair of dust flap end wall panel members 70 and 74, respectively. Scoring line 76 along with scoring lines 64, 68, and 72 define a side wall panel member 78.

Scoring lines 80, 84, and 76 and the edge 82 of a blank 30 define a glue flap 86. Scoring lines 80 and 84 border glue flap projections 88 and 90 respectively. The tips 94 and 96 of glue flap projections 88 and 90 respectively are positioned outwardly of the longitudinal center line 85 of the glue flap 86. The liner 32 substantially covers the carton blank stock and includes an extension area 98 that projects beyond the glue flap 86 as illustrated in FIG. 3. When the liner extension area 98 is folded over the glue flap 86, the liner extension 98 extends over the tips 94 and 96 of the glue flap projections 88 and 90 respectively.

FIG. 4 is a top view of a flat folded lined carton according to the invention. FIG. 4 represents a folded version of the carton stock blank depicted in FIG. 3 and is, therefore, designated generally by the number 30.

The flat folded carton depicted in FIG. 4 is formed by folding the carton blank depicted in FIG. 3 along score lines 64 and 42 in the following matter. Glue is applied along the carton stock side of glue flap 86 including the projections 88 and 90. The liner extension 98 is folded back over the glue treated glue flap 86 so that the liner extends beyond the glue flap projection tips 94 and 96 forming a fin-type seal as is commonly used in forming pouch seals (the folded over liner extension 98 is not depicted in FIG. 4). Heat is applied to side wall panel 44 and liner extension 98 to activate the heat seal coating of the liner material 32; and the heat activated side wall panel 44 is folded over and onto the glue flap 86, including liner extension, thus effecting adhesion between a portion of the panel 44 and the glue flap 86. A pressure wheel is then passed along the combination of glue flap 86 and side wall panel 44 to firmly adhere glue flap 86 and side wall panel 44 in laminar contact. An important and additional benefit of the pressure wheel is that its application of pressure across the glue flap area causes the crushing of the tips of the glue flap projections 88 and 90 since the entire force of the glue wheel becomes concentrated on the small surface area of each tip individually, effectively increasing the unit force such that it becomes a crushing force. This crushing force reduces the thickness of the carton stock adjacent tips 94 and 96 of the glue flap projections 88 and 90 respectively.

Figure 1:
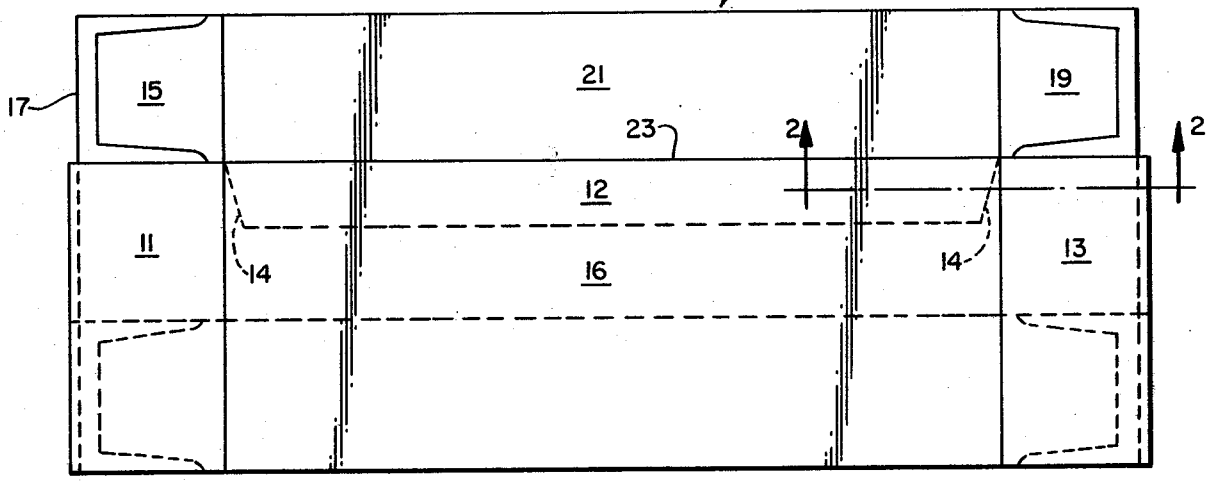
FIG. 1. (PRIOR ART)
FIG. 1 is a top view of a carton blank folded flat which illustrates a prior art embodiment of a lined carton.

The crushing of the glue flap projections 88 and 90 in the area of the glue flap projection tips 94 and 96 eliminates the possibility of any channels being left due to an abrupt differential in the total thickness of the carton. Such channels have been discussed above and illustrated in the "Prior Art" FIG. 2. In lined carton construction, which utilizes a flat edge glue flap 14, as illustrated in prior art FIG. 1, a channel 22 is created between the layers of liner 17 as illustrated in prior art FIG. 2. The absence of channels can be seen in FIG. 5, which is a cross-sectional view of the glue flap area taken along line 5—5 of FIG. 4.

FIG. 5 illustrates the projection 90 of glue flap 86, and liner 32 sandwiched in between the sidewall panels 44 and 66. Liner 32 is bonded to the carton stock blank, and liner extension area 98, which has been folded over, is bonded to the previously uncovered carton stock side of projection 90 of glue flap 86. The glue flap projection tip 96 is positioned between the liner material 32 and liner material extension area 98, both of which are bonded to glue flap 86.

The glue flap projection tip area has been crushed by the pressure wheel so that the tip portion of glue flap projection 90 is thinner toward the outward side of the tip. As viewed in FIGS. 4 and 5, the carton stock of projection 90 of glue flap 86 increases in thickness gradually from tip 96 toward the left end of projection 90 which is positioned below score line 38. The gradually diminishing thickness of the glue flap projection 90 toward its tip eliminates any air channel that might have otherwise been left had a sharp change in thickness occurred at the end of projection 90. (See "Prior Art" FIG. 2 air channel 22).

The application of pressure in the vertical direction with reference to FIG. 5, for example by a pressure wheel, results in the carton stock of the projection tip 96 being thinner in cross section than the carton stock adjacent the left end of projection 90 as viewed in FIG. 5. The gradual change in thickness of projection 90 caused by crushing of the projection tip 96 avoids the abrupt thickness change illustrated in prior art FIG. 2 which causes the leaving of air channel 22.

Figure 2:
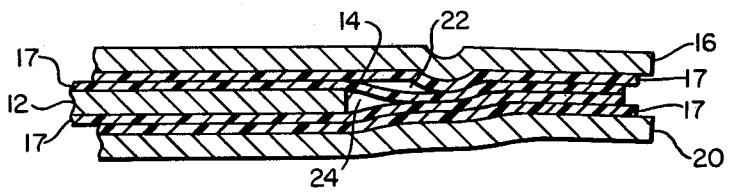
FIG. 2. (PRIOR ART)
FIG. 2 is a cross section view taken along line 2—2 of FIG. 1 showing an area in the vicinity of a glue flap edge of a prior art carton embodiment.

The glue flap 86 of the present invention with projections 88 and 90 eliminates air channels as illustrated in prior art FIG. 2 because the tips 94 and 96 are susceptible to crushing by pressure applied from a glue pressure roller that is used in the art bonding the folded carton. The smaller amount of carton stock material adjacent projections 88 and 90 has increased susceptibility to crushing by the pressure exerted by the glue pressure roller. After application of pressure, the glue flap gradually diminishes in thickness from the left side of projection 90 to the projection tip 96 as illustrated in FIG. 5.

Figure 6:
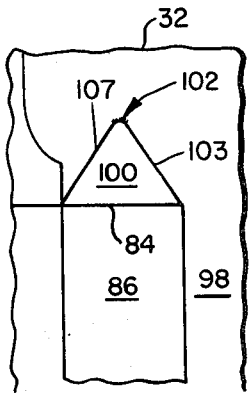
FIG. 6 is an illustration of an embodiment of a glue flap projection according to the present invention.
Figure 7:
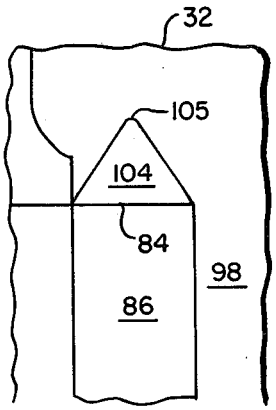
FIG. 7 is an illustration of an embodiment of a glue flap projection according to the present invention.
Figure 8:
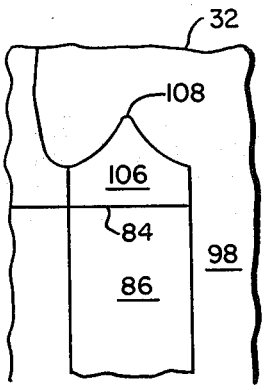
FIG. 8 is an illustration of an embodiment of a glue flap projection according to the present invention.

The glue flap projections may be of any shape that renders the tips susceptible to being made thinner than the thickness of the main portion of the carton stock upon application of pressure to the projection portion. An example of a preferred shape for the glue flap projections is illustrated in FIGS. 3 and 4, the glue flap projections 88 and 90 being in the shape of a nonequilateral triangle. FIGS. 6, 7 and 8 also illustrate alternative embodiments of the glue flap projections.

FIG. 6 shows a glue flap projection 100, according to the invention. The projection is joined to the glue flap at score line 84. Liner material 32 and liner material extension 98 adjoin the glue flap projection 100. The width of the projection 100 becomes narrower as the projection extends outward of the glue flap to the tip of the projection 102. The tip 102 is constructed by terminating cutlines 103 and 107 short of tip 102 so that when the waste carton stock is removed from projection 102, there is a tearing of the uncut segment of carton stock between the adjacent ends of lines 103 and 107, leaving fiber frayed material which not only renders the top more susceptible to crushing; but also the fibers encourage the retension of adhesive for caulking the tip area.

FIG. 7 shows a glue flap projection 104 according to the invention that is triangular in shape. The projection is joined to the glue flap at score line 84. Liner material 32 and liner material 98 adjoin the glue flap projection 104. The tip 105 of the projection 104 is slightly rounded.

FIG. 8 shows a glue flap projection 106 that becomes narrower as the projection extends outward of the glue flap to the tip of the projection. The projection is joined to the glue flap at score line 84. Liner material 32 and liner material extension 98 adjoin the glue flap projection 106. The tip of the projection 108 forms a rounded peak.

The lined carton according to the present invention may be made from many different conventional materials. The carton stock should be susceptible to being crushed by application of pressure to the glue flap projection. An example of carton stock that may be used is 15 point paperboard but there is no limit to the thickness of carton stock material that may be advantageously used. The carton material that may be used is limited only by susceptibility of the lined carton to the elimination of air channels which otherwise may be left because of a thickness differential existing between various adjacent layers of the carton structure.

In the construction of the lined carton according to the invention, it is preferred to locate the tip of the glue flap projection so that it is positioned outwardly of the longitudinal center line of the glue flap to insure that the folded back liner extends beyond the glue flap projection area.

The liner material which is bonded to the carton stock need not extend to the edges of the carton stock. By stopping the liner 32 short of the edge of panel 44, for example, the esthetic appearance of the assembled carton is improved by eliminating any overhang which would mar the appearance of the finished folded lined carton.

In the cross section of FIG. 5, the projection 90 is shown as being crushed with a gradual increase in thickness from a very thin thickness at the tip 96. In this idealized illustration the tip 96 is so thin that there is virtually no need for flowing of adhesive type material around tip 96 to caulk that interesection of layers 98, 32 and 90. In commercial operations, it is entirely possible that a small thickness differential may exist at the tip 96, leaving a small channel not occupied by either the paperboard of tip 90 or the liner portions 32 and 98. To that end, the invention contemplates that the adhesive layer on the liner material, such as a heat sealable polymer at 32 and 98, is flowable and will flow toward any small channel and fill it, such as by a caulking action to close the channel.

The heat sealable polymer may be, for example, 0.5 to 1 mil of low density polyethylene or Surlyn ionomer. Because of this effective action of the heat sealable polymer, in most cases no separate or additional applications of hot melt type adehsives need be used in conjunction with the heat sealable polymer to ensure proper closure of the channel which may exist as at 96 of FIG. 5. Alternately, hot melt adhesives are entirely suitable for use in place of heat sealable polymer at the crushed tip, or may in some embodiments be used in combination with the heat sealable polymer.

More particularly to this point, the free fibers at tip 102 of FIG. 6 are believed to be particularly helpful in assisting with the caulking action, and may facilitate a wider range of constructions and processing conditions which will yield containers functionally accorded the benefits of this invention.

It will be apparent to those skilled in the art that various modifications and variations can be made in the construction of a lined carton according to the present invention which eliminates channels to improve the moisture and vapor proof characteristics of the carton and to provide a carton that is more completely sealed. As an example, there can be an increase or decrease in the number of sides of the carton so that when the carton is folded it forms a different shape than a six sided carton of the illustrated embodiment and yet still may employ the improved glue flap construction for providing a more completely sealed carton. As a further example, the materials used in construction of the lined carton may also vary, i.e., the liner material may be of a radiation sealable type versus a heat sealable type for bonding the carton materials together. Thus, it is intended that the present invention cover modifications and variations of this invention provided they come within the scope of the appended claims and their equivalents.

What is claimed is:

1. A lined carton made of carton stock and a liner, said carton comprising a plurality of sidewall panel members, a glue flap, and a liner substantially covering the carton stock, said liner extending beyond and folding back around and over said glue flap, said glue flap having a main body and a triangular-shaped projection on each end thereof, the thickness of a portion of the carton stock comprising said projections being thinner than the thickness of the rest of said carton stock.

2. A lined carton according to claim 1, wherein the base of each triangular-shaped projection is contiguous with said main body of said glue flap and the free edge of each said projection forms a vertex of a triangle at the tip of said projection.

3. A lined carton according to claim 2, wherein said tip is rounded.

4. A lined carton according to claim 2, wherein said tip is fiber frayed.

5. A lined carton according to claim 2, wherein the thickness of each said projection gradually decreases toward said tip of said projection.

6. A lined carton according to claim 2, 3, 4 or 5, wherein said tip is positioned outwardly of the longitudinal center line of said glue flap.

7. A blank forming a lined carton, said blank comprising:

carton stock of a generally uniform thickness and scored to form a plurality of sidewall panel members and a glue flap having a main body and a triangular-shaped projection on each end thereof, the width of each said projection becoming narrower than the width of said main body of said glue flap as said projection extends outwardly from said main body; and a liner substantially covering the carton stock and extending beyond and folding back around said glue flap.

8. A carton blank according to claim 7, wherein the free edge of each said triangular-shaped projection forms a tip at the vertex of said triangular shape.

9. A carton blank according to claim 8, wherein said tip is rounded.

10. A carton blank according to claim 8, wherein said tip is fiber frayed.

11. A carton blank according to claim 8, 9, or 10, wherein said tip is positioned outwardly of the longitudinal center line of the glue flap.

* * * * *